US009756998B2

(12) United States Patent
Kasper et al.

(10) Patent No.: US 9,756,998 B2
(45) Date of Patent: Sep. 12, 2017

(54) BRUSHROLL FOR VACUUM CLEANER

(71) Applicant: BISSELL Homecare, Inc., Grand Rapids, MI (US)

(72) Inventors: Gary A. Kasper, Grand Rapids, MI (US); Timothy A. Field, Holland, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 549 days.

(21) Appl. No.: 14/289,061

(22) Filed: May 28, 2014

(65) Prior Publication Data

US 2015/0342430 A1 Dec. 3, 2015

(51) Int. Cl.

| | |
|---|---|
| ***A46B 13/02*** | (2006.01) |
| ***A47L 5/30*** | (2006.01) |
| ***A47L 9/04*** | (2006.01) |
| ***A46B 13/00*** | (2006.01) |

(52) U.S. Cl.

CPC ..... *A47L 9/0477* (2013.01); *A46B 13/001* (2013.01); *A46B 13/006* (2013.01); *A47L 5/30* (2013.01); *A47L 9/0411* (2013.01); *A47L 9/0444* (2013.01)

(58) Field of Classification Search

CPC ..... A47L 9/0477; A47L 5/30; A46B 13/001; A46B 13/006

See application file for complete search history.

(56) References Cited

U.S. PATENT DOCUMENTS

| | | | | |
|---|---|---|---|---|
| 1,942,497 | A | 1/1934 | Smellie | |
| 2,459,007 | A | 1/1949 | Taylor | |
| 2,476,537 | A | 7/1949 | Erickson | |
| 2,659,921 | A | 11/1953 | Osborn | |
| 3,188,681 | A * | 6/1965 | Jepson | A47L 5/30 15/324 |
| 3,597,789 | A | 8/1971 | Boyd | |
| 3,716,889 | A | 2/1973 | Goldstein | |
| 3,820,186 | A | 6/1974 | Peabody | |
| 4,042,997 | A | 8/1977 | McDowell et al. | |
| 4,173,807 | A | 11/1979 | Maier | |
| 4,177,536 | A | 12/1979 | Powers | |
| 4,307,479 | A | 12/1981 | Mertes et al. | |
| 4,349,936 | A | 9/1982 | Lorson et al. | |
| 4,372,004 | A | 2/1983 | Vermillion | |
| 4,912,805 | A | 4/1990 | Krasznai et al. | |
| 4,955,102 | A | 9/1990 | Cousins | |
| 5,452,490 | A | 9/1995 | Brundula et al. | |
| 5,495,634 | A | 3/1996 | Brundula et al. | |

(Continued)

FOREIGN PATENT DOCUMENTS

| | | |
|---|---|---|
| GB | 411753 | 6/1934 |
| GB | 491495 | 9/1938 |

(Continued)

*Primary Examiner* — Randall Chin

(74) *Attorney, Agent, or Firm* — McGarry Bair PC

(57) ABSTRACT

A brushroll for a vacuum cleaner includes a dowel defining a central rotational axis about which the brushroll rotates, at least one bristle stiffener, a plurality of first bristles protruding from the dowel adjacent to the bristle stiffener, and a counterbalance which is positioned relative to the bristle stiffener to rotationally balance the brushroll, wherein the cross-sectional shape of the dowel is asymmetrical.

20 Claims, 6 Drawing Sheets

(56) References Cited

U.S. PATENT DOCUMENTS

| | | | |
|---|---|---|---|
| 6,108,853 | A | 8/2000 | Dittus |
| 6,530,106 | B1 | 3/2003 | Brundula |
| 6,539,575 | B1 | 4/2003 | Cohen |
| 6,574,823 | B1 | 6/2003 | Stegens |
| 6,760,952 | B1 | 7/2004 | Stegens |
| 2005/0039282 | A1 | 2/2005 | Paterson et al. |
| 2006/0053584 | A1 | 3/2006 | Dever |
| 2006/0090291 | A1 | 5/2006 | Dever |
| 2006/0117521 | A1 | 6/2006 | Dever |
| 2006/0272122 | A1 | 12/2006 | Butler et al. |
| 2009/0165241 | A1 | 7/2009 | Han et al. |
| 2010/0107359 | A1 | 5/2010 | Yoo |
| 2010/0306957 | A1 | 12/2010 | Follows et al. |
| 2012/0017936 | A1 | 1/2012 | Dant et al. |

FOREIGN PATENT DOCUMENTS

| | | | |
|---|---|---|---|
| GB | 584478 | | 1/1947 |
| GB | 2409405 | B | 12/2005 |
| KR | 1020100088360 | A | 8/2010 |

* cited by examiner

BRUSHROLL FOR VACUUM CLEANER

BACKGROUND

Vacuum cleaners can include an agitator for agitating debris on a surface to be cleaned so that the debris is more easily ingested into the vacuum cleaner. In some cases, the agitator comprises a motor-driven brushroll that rotates within a base or floor nozzle. Brushrolls typically have a generally cylindrical dowel with multiple bristle tufts extending radially from the dowel.

Common types of brushrolls include injection-molded or wooden dowels, and may be drilled with holes for tufting with bristles. The shapes for the injection-molded dowel can be limited by tooling constraints and by the desire to maintain rotational balance of the brushroll during operation. In order to produce parts from a simple two-part tool and in order to maintain a straight line of draw, the injection-molded dowel must be symmetrical about its central axis, resulting in a symmetrical bristle pattern. Four-part tools with moving slides can be used to produce more complex dowel shapes with features that are not in the line of draw, but these dowels too are typically symmetrical about their central axis in order to maintain rotational balance during operation. Dowels machined out of wood allow for different bristle patterns. One feature found on some wooden dowels is a bristle stiffener that is molded as a separate strip and slid into a machined channel in the wooden dowel adjacent to the tufting area.

BRIEF SUMMARY

According to one aspect of the invention, a brushroll for a vacuum cleaner includes a dowel defining a central rotational axis and having at least one axial segment, a bristle stiffener defining the axial length of the axial segment, a plurality of first bristles protruding from the dowel adjacent to the bristle stiffener, and a counterbalance within at least a portion of the axial segment and positioned relative to the bristle stiffener to rotationally balance the at least one axial segment about the central rotational axis, wherein the cross-sectional shape of the dowel is asymmetrical along the at least one axial segment.

DETAILED DESCRIPTION

The invention relates to vacuum cleaners and in particular to vacuum cleaners having a motor-driven brushroll. For purposes of description related to the figures, the terms "upper," "lower," "right," "left," "rear," "front," "vertical," "horizontal," and derivatives thereof shall relate to the invention as oriented in FIG. 1 from the perspective of a user behind the vacuum cleaner, which defines the rear of the vacuum cleaner. However, it is to be understood that the invention may assume various alternative orientations, except where expressly specified to the contrary.

Figure 1:
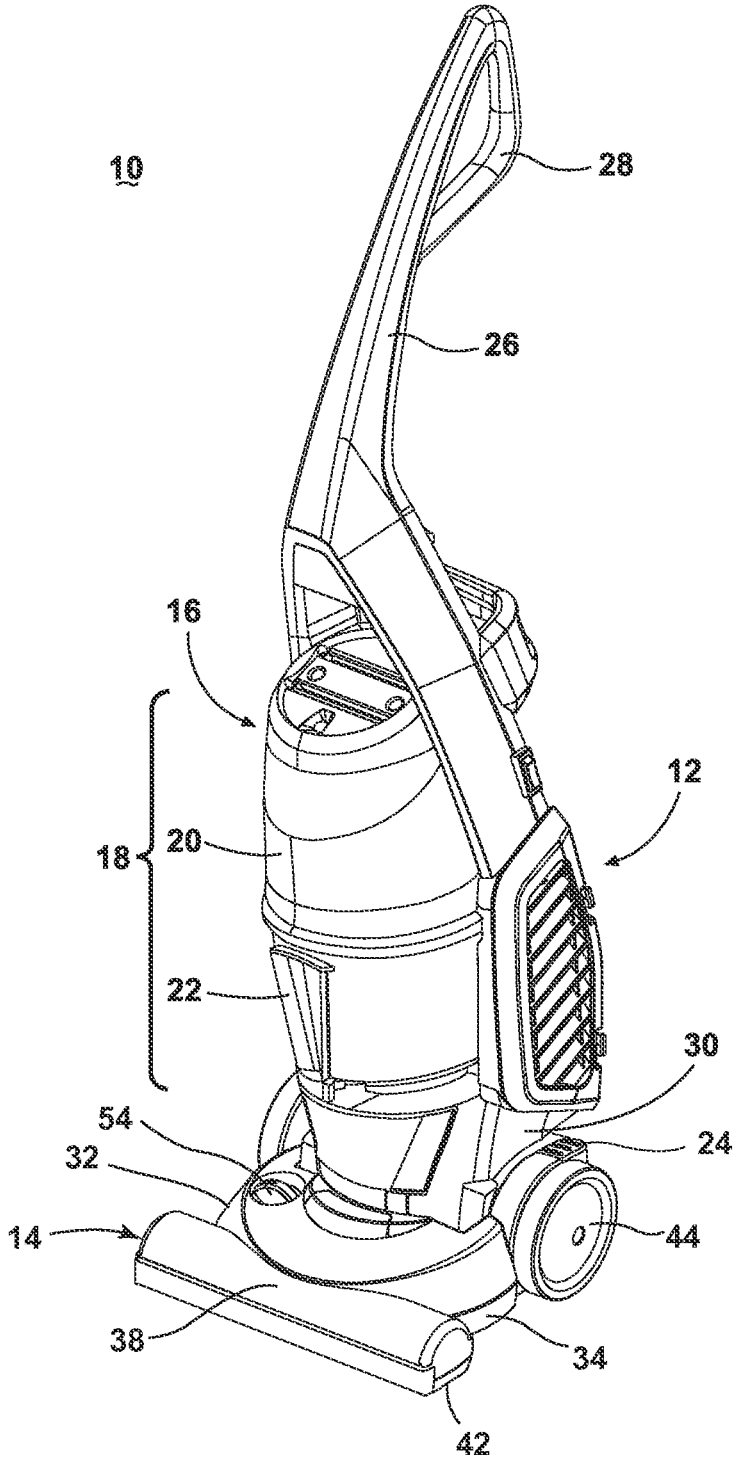
FIG. 1 is a perspective view of a vacuum cleaner.

FIG. 1 is a perspective view of the vacuum cleaner 10 in the form of an upright vacuum cleaner. While shown and referred to herein as an upright vacuum cleaner, the vacuum cleaner 10 can alternatively be configured as a hand-held vacuum cleaning device, or as an apparatus having a floor nozzle or a hand-held accessory tool connected to a canister or other portable device by a vacuum hose. Additionally, the vacuum cleaner 10 can be configured to have fluid distribution capability and/or extraction capability.

As illustrated, the vacuum cleaner 10 comprises an upper housing 12 pivotally mounted to a lower base 14. The upper housing 12 generally comprises a main support section 16 supporting a collection system 18 for separating and collecting contaminants from a working airstream for later disposal. In one conventional arrangement illustrated herein, the collection system 18 can include a cyclone separator 20 for separating contaminants from a working airstream and a removable dirt cup 22 for receiving and collecting the separated contaminants from the cyclone separator 20. The cyclone separator 20 can have a single cyclonic separation stage, or multiple stages. In another conventional arrangement, the collection system 18 can include an integrally formed cyclone separator and dirt cup, with the dirt cup being provided with a bottom-opening dirt door for contaminant disposal. It is understood that other types of collection systems 18 can be used, such as centrifugal separators or bulk separators. In yet another conventional arrangement, the collection system 18 can include a filter bag. The vacuum cleaner 10 can also be provided with one or more additional filters upstream or downstream of the collection system 18.

The upper housing 12 is pivotally mounted to the base 14 for movement between an upright storage position, shown in FIG. 1, and a reclined use position (not shown). The vacuum cleaner 10 can be provided with a detent mechanism, such as a pedal 24 pivotally mounted to the base 14, for selectively releasing the upper housing 12 from the storage position to the use position. The details of such a detent pedal 24 are known in the art, and will not be discussed in further detail herein.

The upper housing 12 also has an elongated handle 26 extending upwardly from the main support section 16 that is provided with a hand grip 28 at one end that can be used for maneuvering the vacuum cleaner 10 over a surface to be cleaned. A motor cavity 30 is formed at a lower end of the support section 16 and contains a conventional suction source such as a motor/fan assembly 36 (FIG. 2) positioned therein in fluid communication with the collection system 18. The vacuum cleaner 10 can also be provided with one or more additional filters upstream or downstream of motor/fan assembly.

Figure 2:
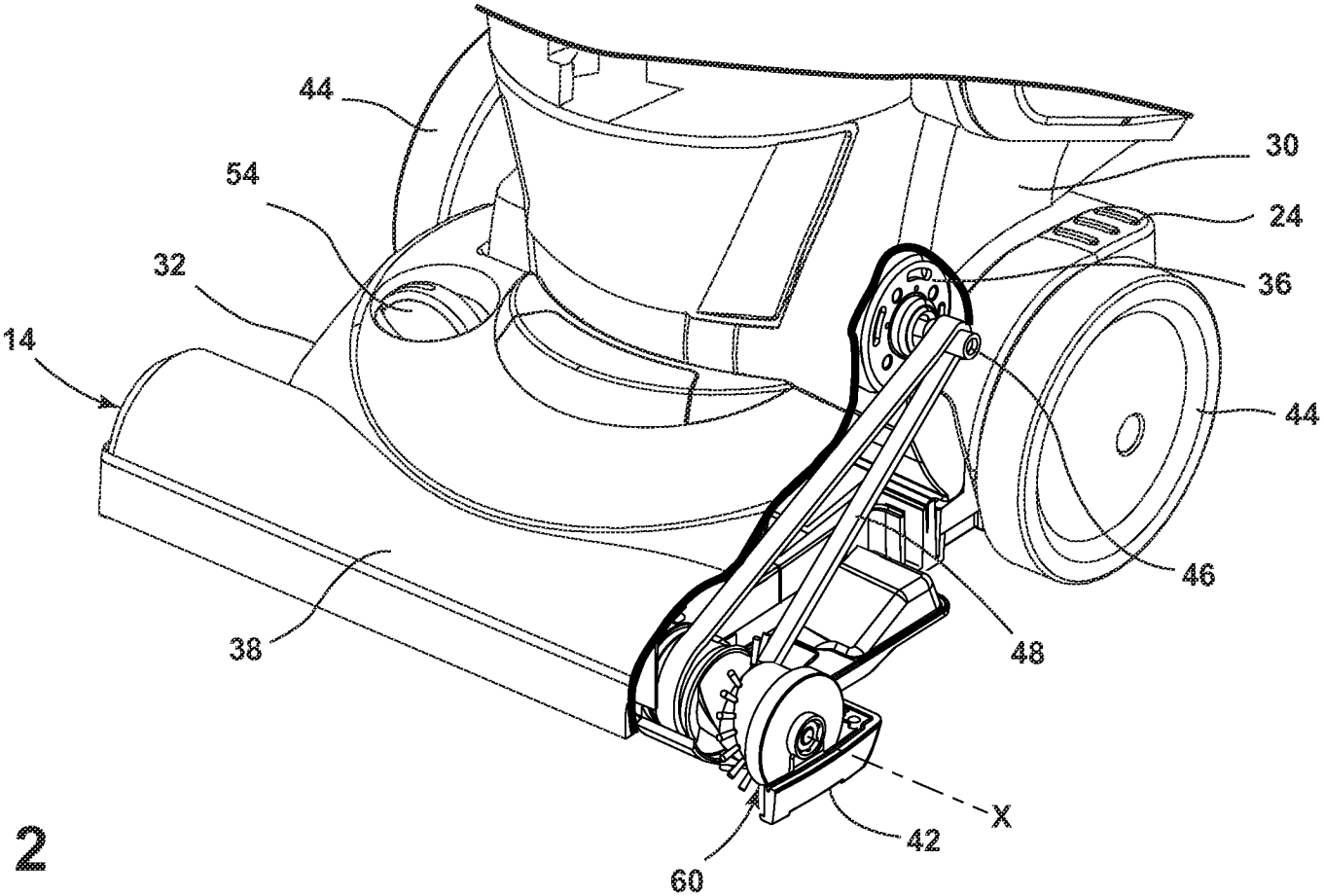
FIG. 2 is a perspective view of a lower portion of the vacuum cleaner from FIG. 1, with portions cut away for clarity.

FIG. 2 is a view of a lower portion of the vacuum cleaner 10 from FIG. 1, with portions cut away to show features of the base 14. The base 14 can include an upper housing 32 that couples with a lower housing 34 to create a partially enclosed space therebetween. An agitator chamber 38 can be provided at a forward portion of the lower housing 34 for receiving a brushroll 60. A suction nozzle opening 42 is formed in the lower housing 34 and is in fluid communication with the agitator chamber 38 and the collection system 18 (FIG. 1). Wheels 44 can be provided on the base 14 for maneuvering the vacuum cleaner 10 over a surface to be cleaned.

The brushroll 60 is positioned within the agitator chamber 38 for rotational movement about a central rotational axis X. A single brushroll 60 is illustrated; however, it is within the scope of the invention for dual rotating brushrolls to be used. Moreover, it is within the scope of the invention for the brushroll 60 to be mounted within the agitator chamber 38 in a fixed or floating vertical position relative to the chamber 38 and lower housing 34.

The brushroll 60 can be operably coupled to and driven by the motor/fan assembly 36 in the motor cavity 30. The motor/fan assembly 36 can comprise a motor shaft 46 which is oriented substantially parallel to the surface to be cleaned and protrudes from the motor cavity 30 into a rear portion of the base 14. A drive belt 48 operably connects the motor shaft 46 to the brushroll 60 for transmitting rotational motion of the motor shaft 46 to the brushroll 60. Alternatively, a separate, dedicated agitator drive motor (not shown) can be provided within the base 14 to drive the brushroll 60.

The base 14 can further include an optional suction nozzle height adjustment mechanism for adjusting the height of the suction nozzle opening 42 with respect to the surface to be cleaned. A rotatable knob 54 for actuating the adjustment mechanism can be provided on the exterior of the base 14. In another variation, the suction nozzle height adjustment mechanism can be eliminated.

In operation, the vacuum cleaner 10 draws in debris-laden air through the base 14 and into the collection system 18 where the debris, which can include, but is not limited to, dirt, dust, hair, and other debris, is substantially separated from the working air flow, which is generated by the motor/fan assembly 36. The spinning motor shaft 46 of the motor/fan assembly 36 rotates the brushroll 60 via the drive belt 48 that is operably connected therebetween. Alternatively, a separate, dedicated agitator drive motor can rotate the brushroll 60. As the brushroll 60 rotates, the bristles sweep across the surface to be cleaned to release and propel debris into the working air flow generated by the motor/fan assembly 36, which carries the debris into the collection system 18. The working air flow then passes through the motor cavity 30 and past the motor/fan assembly 36 prior to being exhausted from the vacuum cleaner 10. The collection system 18 can be periodically emptied of debris.

Figure 3:
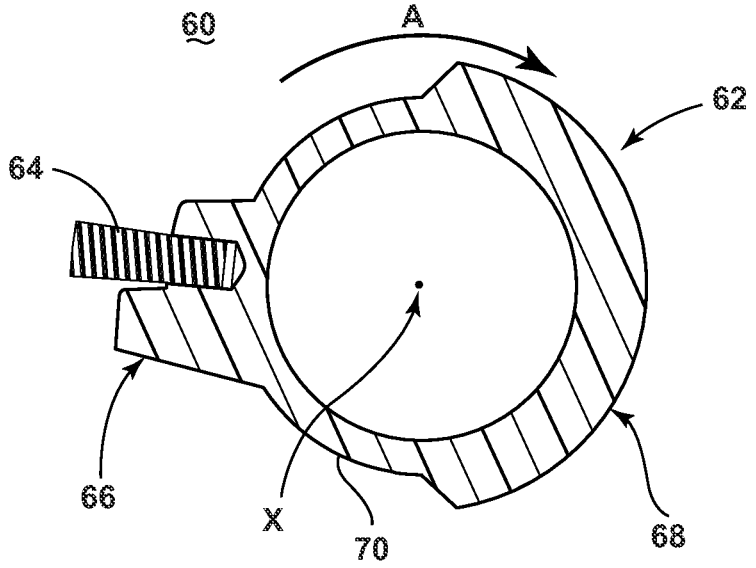
FIG. 3 is a schematic cross section of a brushroll according to a first embodiment of the invention.

FIG. 3 is a schematic cross section of the brushroll 60 according to a first embodiment of the invention. The brushroll 60 can be used with the vacuum cleaner 10 of FIG. 1-2, as described above, or with other vacuum cleaners. The brushroll 60 includes a generally cylindrical brush dowel 62 configured to be mounted for rotation about a central rotational axis X extending longitudinally through the dowel 62. The brushroll 60 illustrated is configured to be rotationally driven in the direction indicated by arrow A.

A plurality of bristles 64 protrude from the dowel 62, and are provided adjacent to a bristle stiffener 66 that projects or extends from the brush dowel 62. The bristle stiffener 66 can define the axial length, i.e. the length relative to the central rotational axis X, of an axial segment of the dowel 62. The axial segment, and thus the bristle stiffener 66 can extend substantially the full length of the dowel 62, or some sub-length of the dowel 62 that is less that the full length.

A counterbalance 68 lies within at least a portion of the axial segment and is positioned relative to the bristle stiffener 66 to rotationally balance the at least one axial segment of the dowel 62 about the central rotational axis X. In rotational balance, the mass of the brushroll 60 is evenly distributed about the central rotational axis X. Rotational balance of the entire brushroll 60 is important in order to avoid vibration and unwanted noise during operation, and further to avoid wear on the bearings mounting the brushroll 60 to the vacuum cleaner.

The counterbalance 68 can project or extend from the brush dowel 62 and can be positioned diametrically opposite the bristle stiffener 66. The counterbalance 68 does not include a bristle stiffener. In the illustrated example, the counterbalance 68 further does not include any bristles, but it will be understood from further embodiments that some bristles, preferably unstiffened, may protrude from the counterbalance 68 so that the entire mass of the counterbalance 68 offsets the mass of the opposing bristle stiffener and bristle 64 combination.

As shown, the counterbalance 68 is not required to duplicate the shape of the bristle stiffener 66 in order to keep the dowel 62 in rotational balance, but rather can have other geometries in order to optimize brush performance and manufacturability. However, the bristle stiffener 66 and counterbalance 68 can be provided on a symmetrical core 70 of the dowel 62. The core 70 can be substantially cylindrical in shape, and can be centered about the rotational axis X. In one example, the bristle stiffener 66 and counterbalance 68 can be integrally molded with the core 70 of the dowel 62. The bristles 64 can be assembled with the dowel 62 during a subsequent tufting operation. It is further noted that the respective shapes of the bristle stiffener 66 and counterbalance 68 can vary from the shape shown in FIG. 3; in one example, in which the dowel 62 is formed by injection molding, the bristle stiffener 66 and counterbalance 68 can be configured for removal from a two-part mold.

Figure 4:
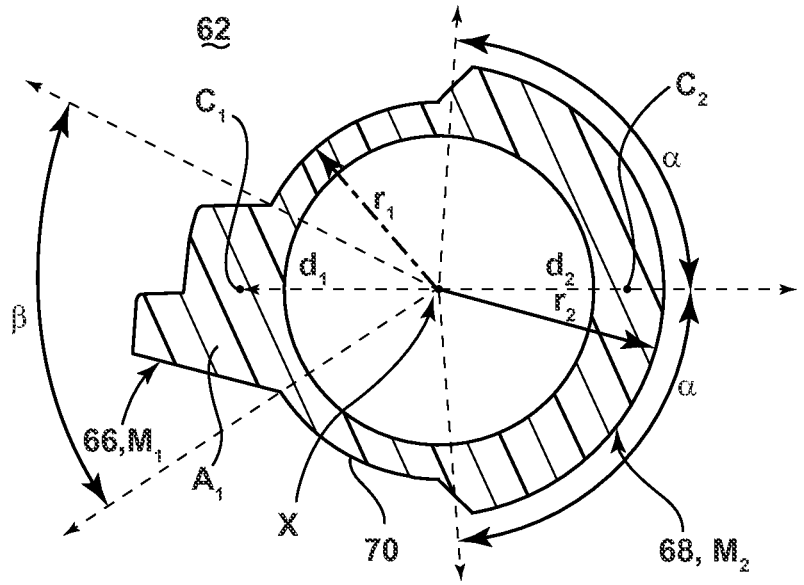
FIG. 4 is a schematic cross section of a dowel of the brushroll from FIG. 3.

FIG. 4 is a schematic cross section of the dowel 62 from FIG. 3. As can be seen in FIG. 4, the overall cross-sectional shape of the dowel 62 is asymmetrical along the at least one axial segment, relative to the central rotational axis X, while remaining rotationally balanced. As noted above, the axial segment, and thus the bristle stiffener 66 can extend substantially the full length of the dowel 62, resulting in a dowel 62 that is asymmetrical along its entire length. In other cases, the axial segment, and thus the bristle stiffener 66, may extend an amount that is less than the full length of the dowel 62, with the dowel 62 being asymmetrical along the sub-length, which provides the option of having one or more symmetrical axial segments outside the asymmetrical axial segment containing the bristle stiffener 66. In this case, the brushroll 60 as a whole remains in rotational balance.

The asymmetry of the brush dowel 62 can be created by the irregular and non-symmetrical shapes of the bristle stiffener 66, which defines a stiffener section $M_1$ and the counterbalance 68, which defines a balancing mass $M_2$ provided in order to keep the dowel 62 in rotational balance.

The balancing mass $M_2$ is configured with a sufficient radius $r_2$ and sweep angle $2\alpha$ to act as a counterbalance for the stiffener section $M_1$. The radius $r_2$ of the balancing mass $M_2$ is the distance between the central rotational axis X of the dowel 62 and the radial surface of the balancing mass $M_2$. While the radial surface of the balancing mass $M_2$ is shown here as having a constant distance from the central rotational axis X, it is also within the scope of the invention for the radial surface of the balancing mass $M_2$ to have a non-constant distance from the central rotational axis X along the sweep angle $2\alpha$. The sweep angle (or angle of sweep) $2\alpha$ of the balancing mass $M_2$ is the number of degrees spanned by the balancing mass $M_2$ on the circumference of the core 70.

Given a known or desired design for the bristle stiffener 66 and core 70, the design for the counterbalance 68 can be determined using the following method. The bristle stiffener 66 defined by the stiffener mass $M_1$ will have a known cross-sectional area $A_1$ and radius $d_1$ to its center of mass $C_1$. The core 70 of the dowel 62 will have a known outside radius $r_1$. From this information, either of the radius $r_2$ or sweep angle $2\alpha$ of the balancing mass $M_2$ can be selected, and the other calculated using the following equation:

$$A_1 d_1 = \frac{2}{3}\sin\alpha\,(r_2^3 - r_1^3)$$

The center of mass $C_1$ of the stiffener mass $M_1$ may be diametrically opposite the center of mass $C_2$ of the balancing mass $M_2$, with the sweep angle $2\alpha$ of the balancing mass $M_2$ equally distributed relative to the center of mass $C_2$. Due to the more irregular shape of the bristle stiffener 66, the sweep angle $\beta$ of the stiffener mass $M_1$ may not be equally distributed relative to its center of mass $C_1$. Here, the sweep angle $2\alpha$ of the counterbalance 68 is greater that the sweep angle $\beta$ of the bristle stiffener 66; thus, the counterbalance 68 extends a greater circumferential distance around the core 70 than the bristle stiffener 66. Here also, the radius $d_1$ to the center of mass $C_1$ of the bristle stiffener 66 is not equal to the radius $d_2$ to the center of mass $C_2$ of the counterbalance 68, and is particularly shown here as being greater than the radius $d_2$.

While only a cross section of the brushroll 60 and dowel 62 are shown in FIGS. 3-4, it is understood that the bristle stiffener 66 defined by the stiffener mass $M_1$ may extend along the length of the dowel 62, such as but not limited to being oriented along a helix with respect to the central rotational axis X. Furthermore, multiple bristle stiffeners 66 may be provided along the length of the dowel 62, which can be conceptually divided into multiple axial segments. Likewise, multiple counterbalances 68 corresponding to the multiple bristle stiffeners 66 can also be provided to maintain a rotationally-balanced dowel 62.

Figure 5:
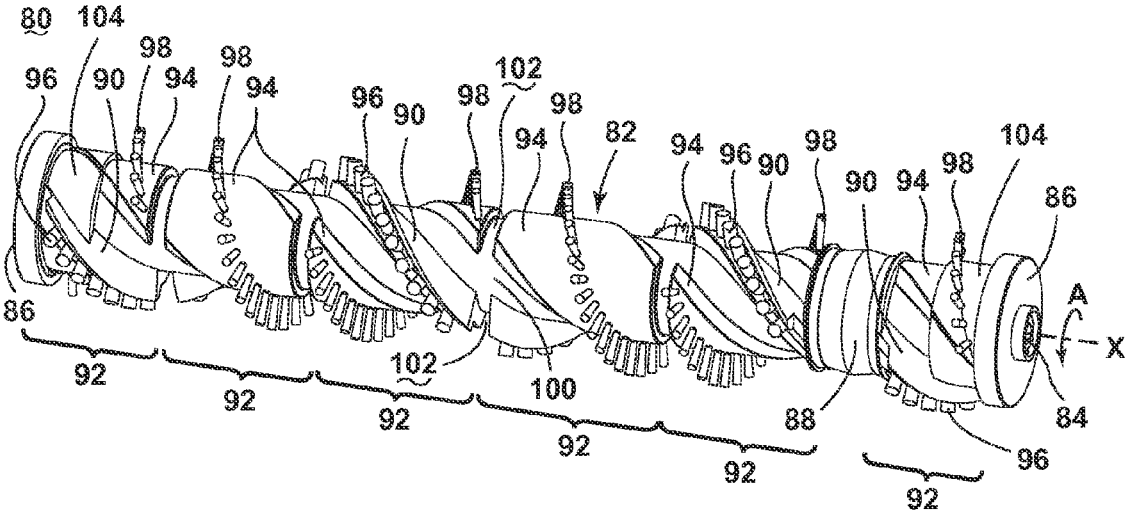
FIG. 5 is a perspective view of a brushroll according to a second embodiment of the invention.
Figure 6:
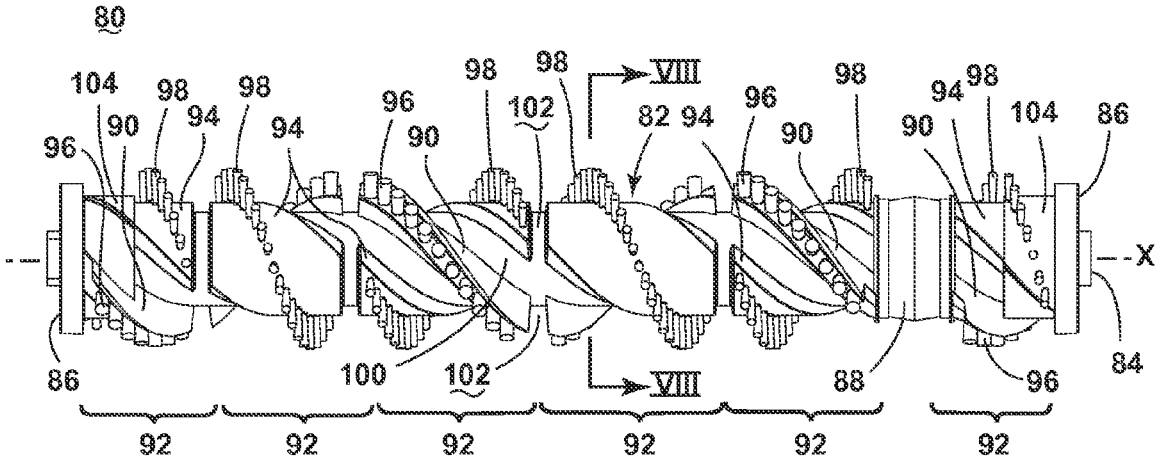
FIG. 6 is a front view of the brushroll from FIG. 5.

FIGS. 5-6 are perspective and front views, respectively of a brushroll 80 according to a second embodiment of the invention. The brushroll 80 can be used with the vacuum cleaner 10 of FIG. 1-2, as described above, or with other vacuum cleaners. The brushroll 80 can further be configured with a generally cylindrical brush dowel 82 having a geometry in accordance with the principles outlined for the brushroll 60 schematically illustrated and described for FIGS. 3-4.

The brush dowel 82 is mounted on an elongated shaft 84 that extends through the center of the dowel 82 and defines the central rotational axis X around which the brushroll 80 rotates. The brushroll 80 illustrated is configured to be rotationally driven in the direction indicated by arrow A. A bearing 86 is mounted on each end of the shaft 84. In operation, the dowel 82 rotates about the shaft 84 on the bearings 86. A belt engagement surface 88 extends around the circumference of the dowel 82 near one end, and communicates with the belt 44 (FIG. 2). The belt engagement surface 88 may comprise a pulley.

A plurality of bristle stiffeners 90 project or extend from the brush dowel 82. The bristle stiffeners 90 can define the axial length, i.e. the length relative to the central rotational axis X, of an axial segment 92 of the dowel 82. The dowel 82 can be conceptually divided into multiple axial segments 92, with each axial segment 92, and thus each bristle stiffener 90, extending a portion of the dowel 82 length that is less than the full length of the dowel 62.

A counterbalance 94 can be associated with each bristle stiffener 90, and can lie within at least a portion of each axial segment 92. The counterbalance 94 is configured to rotationally balance the axial segment 92 about the central rotational axis X of the dowel 82. The counterbalance 94 may be diametrically opposite the bristle stiffener 90. The counterbalance 94 does not include a bristle stiffener.

A first group of bristle tufts 96 project or extend from the brush dowel 82 adjacent to the bristle stiffener 90, and a second group of bristle tufts 98 project or extend from the brush dowel 82 non-adjacent to or spaced from the bristle stiffener 90. The first group of bristle tufts 96 may be referred to herein as stiffened bristle tufts due to their proximity to and engagement with the bristle stiffeners 90 during operation of the brushroll 80, as described in more detail below, while the second group of bristle tufts 98 may be referred to herein as unstiffened bristle tufts since they are spaced from and do not engage any of the bristle stiffeners 90 during operation of the brushroll 80.

Each bristle tuft 96, 98 can include a plurality of flexible bristles, which may be made from a durable polymer material such as nylon or polyester, for example. One advantage of incorporating bristle stiffeners 90 is that the stiffened bristle tufts 96 can be softer than the unstiffened bristle tufts 98, which reduces the amount of power needed to rotate the brushroll 80 and improves overall cleaning efficiency. Both types of bristle tufts 96, 98 can flex as the brushroll 80 rotates, however the bristle stiffeners 90 reduce tuft flexure as compared to stiffened bristle tufts 96 without the bristle stiffeners 90. The individual bristles making up the bristle tufts 96, 98 are not illustrated herein for the sake of simplicity.

Each set of stiffened bristle tufts 96 is positioned adjacent a corresponding bristle stiffener 90 and can extend along substantially the entire length of the axial segment 92. The bristle stiffeners 90 are positioned adjacent to a rear side of the bristle tufts 96, with "rear" in this case being defined in relation of the direction of rotation A, such that upon the bristle tufts 96 engaging a surface to be cleaned, the bristle tufts 96 are prevented from bending over too far by the bristle stiffeners 90. Overall, the bristle stiffeners 90 tend to keep the bristle tufts 96 more or less erect as they pass over the surface to be cleaned. The bristle stiffeners 90 are substantially rigid, and do not flex as the brushroll 80 rotates.

As illustrated, the stiffened bristle tufts 96 can wrap around the dowel 82 in a helical pattern along with the bristle stiffener 90. The helical pattern can be defined by a single helix, such that all of the bristle tufts 96 lie along a single, common helix with respect to the central rotational axis X. The bristle stiffeners 90 follow the same helical pattern, save for being slightly offset from the helix in which the bristle tufts 96 lie.

In the illustrated embodiment, the bristle stiffeners 90 and stiffened bristle tufts 96 on each axial segment 92 wrap approximately 180° around the dowel 82. The bristle stiffeners 90 and stiffened bristle tufts 96 lie along a substantially continuous, helical pattern and cumulatively span approximately 810° around the dowel 82. However, it is contemplated that the helical pattern, such as the pitch of the helix for example, can be modified so that the total angular coverage of the bristle stiffeners 90 and stiffened bristle tufts 96 can be increased or decreased to any desired value. And because a counterbalance 94 is associated with each bristle stiffener 90 to rotationally balance each axial segment 92 about the central rotational axis X of the dowel 82, the helical pattern can be modified without disrupting the rotational balance of the dowel 82. Thus, a wide variety of helical patterns and dowel features, such as dowel lengths and pulley or belt engagement surface 88 sizes and locations, can be accommodated. A four part mold with moving slides is used to mold the dowel 82 shown in the figures because portions of the bristle stiffeners 90 are undercut and thus cannot currently be formed in a two part mold.

The unstiffened bristle tufts 98 can be provided on the counterbalances 94, and can wrap around the dowel 82 in a helical pattern, but may not lie along a single common helix. Instead, each set of unstiffened bristle tufts 98 lie along its own helix with respect to the central rotational axis X. The pitch of the helix for each set of unstiffened bristle tufts 98 can be approximately equal to each other, and adjacent sets may overlap each other. Each axial segment 92 of unstiffened bristle tufts 98 covers approximately 180° of the dowel 82, while all of the unstiffened bristle tufts 98 together span approximately 1070° around the dowel 82, with a $2\alpha$ overlap between adjacent axial segments 92 of unstiffened bristle tufts 98. Other patterns for the bristle tufts 98 are also contemplated. Additionally, the angle at which the bristle tufts 96, 98 are oriented and the degree of coverage about the dowel 82 can vary.

In an alternate embodiment (not shown) the helical pattern of the bristle stiffener 90 can be modified to eliminate undercut portions so the dowel 82 can be molded in a less complex and less costly two part mold. For example, the bristle stiffener 90 and stiffened bristle tufts 96 on each axial segment 92 can wrap approximately 90° around the dowel 82. The bristle stiffeners 90 on adjacent axial segments 92 can be positioned on opposing surfaces of the dowel 82 and in the line of draw without any undercut portions. In this alternate configuration, the bristle stiffeners 90 and stiffened bristle tufts 96 form an interrupted and alternating helical pattern around the dowel 82 instead of a continuous helical pattern as in the previous embodiment. And unstiffened bristle tufts 98 can be provided on counterbalances 94.

The bristle stiffeners 90 and counterbalances 94 can be provided as ridges which project or extend from an exterior surface of a core 100 of the brush dowel 82. Circumferential gaps 102 can extend around the dowel 82 to separate adjacent bristle stiffeners 90 and counterbalances 94, and further allow the rotating brushroll 80 to clear ribs on the lower housing 34 that prevent carpet from getting drawn into the suction nozzle opening 42 (FIG. 1).

Using bristle stiffeners 90 and counterbalances 94, which extend as ridges from the core 100, can minimize the amount of material needed for the dowel 82 by locally increasing the diameter of the dowel 82 where the bristle stiffeners 90 and counterbalances 94 are located, rather than increasing the entire diameter of the dowel 82.

Spools 104 can be formed at the ends of the dowel 82, adjacent to the bearings 86, for preventing hair and other debris from migrating along the dowel 82 towards the bearings 86. At least a portion of some of the bristle stiffeners 90 and tufts 96, 98 at the ends of the dowel 82 can extend onto the spools 104. Portions of the spools 104 may also act as counterbalances for the stiffeners 90. The spools 104 may define the same overall diameter as that defined by the bristle stiffeners 90 or counterbalances 94, or may have a slightly larger or slightly smaller diameter than either. In the embodiment illustrated herein, the spools 104 define a slightly larger diameter of the dowel 82 than the diameter defined by the counterbalances 94, but a slightly smaller diameter than defined by the bristle stiffeners 90.

Figure 7:
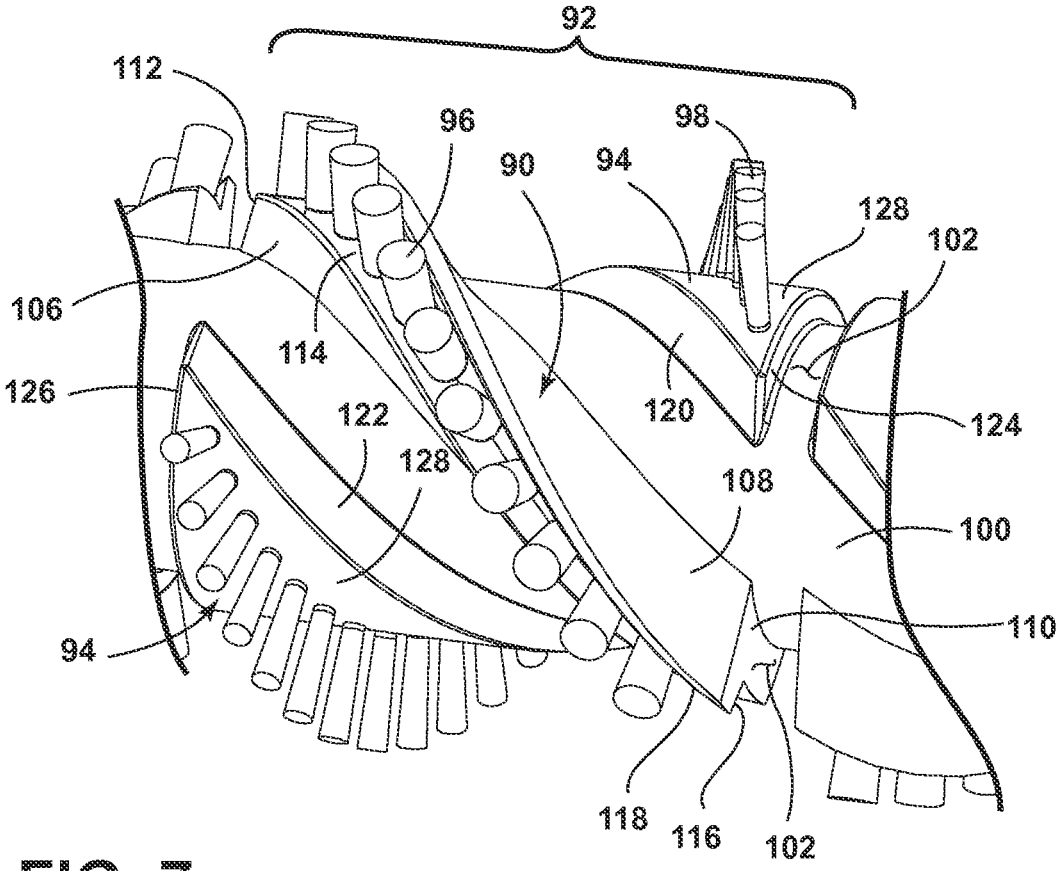
FIG. 7 is a close-up view of an axial segment of the brushroll from FIG. 5.

FIG. 7 is a close-up view of an axial segment 92 of the brushroll 80 from FIG. 5. Each bristle stiffener 90 has a leading surface 106 and a trailing surface 108, as defined by the direction of rotation A (FIG. 5), which project from the core 100 of the brush dowel 82 and are joined by two end surfaces 110, 112. A bristle surface 114 extends, between the two end surfaces 110, 112, from the leading surface 106 to an upwardly extending stiffener surface 116, which joins the trailing surface 108 at a stiffener tip 118. The height of the stiffener tip 118 relative to the core 100 can be substantially constant along the length of the bristle stiffener 90 and is higher than the bristle surface 114, but can be positioned below the distal end of the bristle tufts 96.

The leading surface 106 and the trailing surface 108 can be non-planar, with a longitudinal twist formed in the leading surface 106 and the trailing surface 108, such that the second end surface 112 is radially offset from the first end surface 110. During rotation, bristle tufts 96 near the first end surface 110 will contact the surface to be cleaned first, with the bristle tufts 96 closer to the second end surface 112 sequentially following. The stiffener tip 118 braces the bristle tufts 96 to keep the bristle tufts 96 more or less erect as they pass over the surface to be cleaned.

Each counterbalance 94 supporting the unstiffened bristles 98 also has a leading surface 120 and a trailing surface 122, as defined by the direction of rotation, which project from the exterior surface of the brush dowel 82 and are joined by two end surfaces 124, 126 and an upper surface 128. The leading surface 120 and the trailing surface 122 can be non-planar, with a longitudinal twist formed in the surfaces 120, 124, such that the second end surface 126 is radially offset from the first end surface 124. The counterbalance 94 can follow a similar helical pattern as the bristle stiffeners 90, with the leading surface 120 and a trailing surface 122 wrapping helically around the dowel 82 relative to the central rotational axis X.

During rotation, bristle tufts 98 near the first end surface 124 will contact the surface to be cleaned first, with the bristle tufts 98 closer to the second end surface 126 following. Furthermore, the leading surface 120 of the counterbalance 94 can be circumferentially spaced from the trailing surface 108 of the bristle stiffener 90. Likewise, the trailing surface 122 of the counterbalance 94 can be circumferentially spaced from the leading surface 106 of the bristle stiffener 90.

As illustrated, the counterbalance can substantially span the length of the axial segment 92, with the end surfaces 124, 126 of the counterbalance 94 being substantially aligned with the end surfaces 110, 112 of the bristle stiffener 90. In other configurations, the counterbalance 94 may have a length that is less than or greater than the length of the bristle stiffener 90. In still other configurations, the counterbalance may have a length that is substantially equal to the length of the bristle stiffener 90, but may be axial offset from the bristle stiffener 90, such that one or both of the end surfaces 124, 126 of the counterbalance 94 are not aligned with the end surfaces 110, 112 of the bristle stiffener 90.

Figure 8:
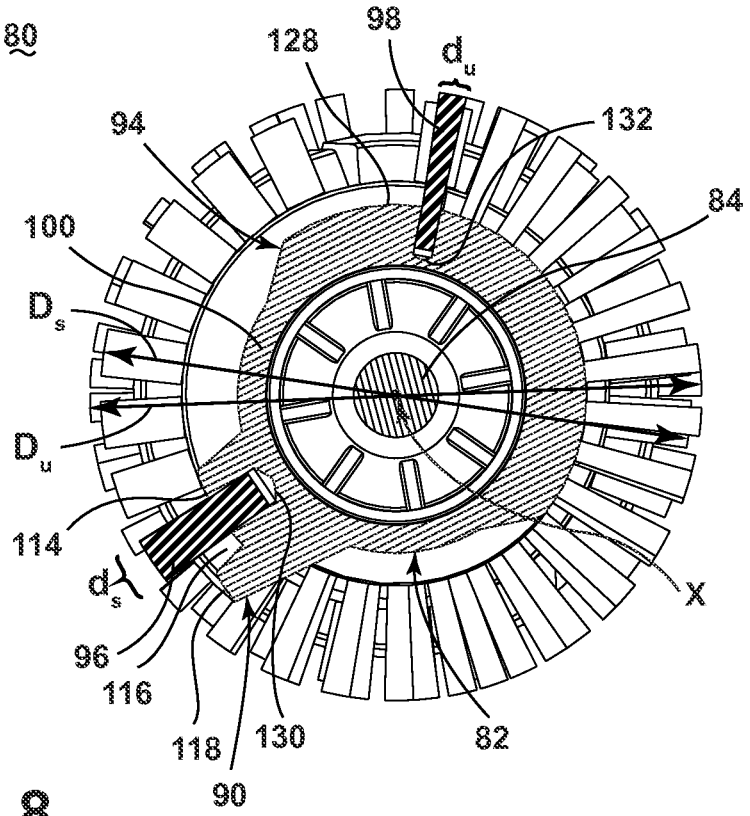
FIG. 8 is a cross-sectional view of the brushroll taken through line VIII-VIII of FIG. 6.

FIG. 8 is a cross-sectional view of the brushroll 80 taken through line VIII-VIII of FIG. 6. Bristle holes 130 for the stiffened bristle tufts 96 can be formed in the bristle surface 114 of the bristle stiffener 90 and can extend at least partially into the bristle stiffener 90. Bristle holes 132 for the unstiffened bristle tufts 98 can be formed in the upper surface 128 of the counterbalance 94 and can extend at least partially into the counterbalance 94. One of both of the holes 130, 132 can further extend at least partially into the core 100 of the dowel 82.

The bristle holes 130, 132 can be formed in the dowel 82 by drilling into the dowel 82 after molding, or can be integrally molded with the dowel 82. The bristle tufts 96, 98 can be assembled with the dowel 82 by pressing bristles into the bristle holes 130, 132, respectively, and securing the bristles using a fastener (not shown), such as, but not limited to, a staple, wedge, or anchor.

The bristle holes 130 for the stiffened bristle tufts can be provided adjacent to the bristle stiffener 90, such that there is a small or even negligible gap between the stiffener surface 116 and the closest portion of the bristle tuft 96. In one example, the gap can be approximately 0-0.5 mm.

As shown herein, the bristle tufts 96, 98 have different tuft diameters, with the tuft diameter $d_S$ of the stiffened bristle tuft 96 being larger than the tuft diameter $d_U$ of the unstiffened bristle tuft 98. Further as shown herein, the bristle tufts 96, 98 define different bristle trim diameters, such that the unstiffened bristle tufts 98 are longer and define a larger bristle trim diameter $D_U$ than the stiffened bristle tufts 96, which are shorter and define a smaller bristle trim diameter $D_S$. The larger bristle trim diameter $D_U$ allows the unstiffened bristle tufts 96 to selectively contact a lower floor surface, such as a bare floor, which is considered "lower" relative to the brushroll 80 in the comparison to a "higher" floor surface such as carpeting. The stiffened bristle tufts 96 are kept out of contact with the lower floor surface. The non-stiffened bristle tufts 104 will sweep, but not scratch, a bare floor. The stiffened bristle tufts 66 only contact higher surfaces like carpet, which is more forgiving and requires more of a beating action to be effectively cleaned. In another configuration, the tufts 96, 98 can be trimmed to the same bristle trim diameter.

Further as shown herein, the bristle tufts 96, 98 both extend along axes which pass through the central rotational axis X of the brushroll 80 defined by the shaft 84. However, in another configuration, one or both of the tufts 96, 98 can extend along axes which are offset from and do not pass through the central rotational axis X.

Figure 9:
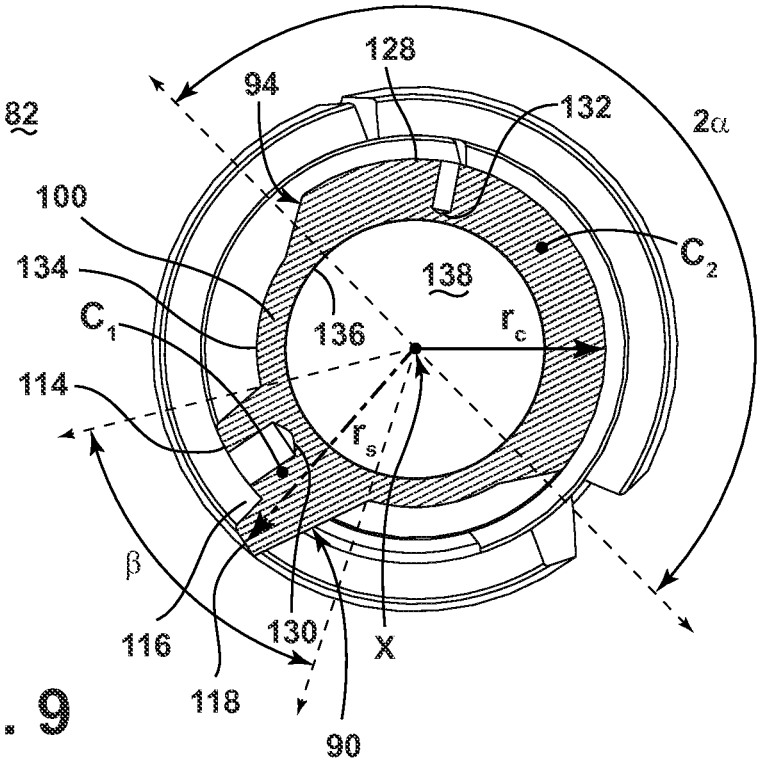
FIG. 9 is a cross-sectional view similar to FIG. 8 showing a dowel of the brushroll alone.

FIG. 9 is a cross-sectional view similar to FIG. 8 showing the dowel 82 of the brushroll 80 alone. In the illustrated cross section, the dowel 82 has an irregular or asymmetrical shape about the central rotational axis X, with the bristle stiffener 90 and counterbalance 94 having dissimilar shapes projecting or extending from the core 100 of the dowel. However, the core 100 of the dowel 82 can define a symmetrical shape about the central rotational axis X, and may in particular be formed as an annulus having an outer peripheral surface 134, from which the bristle stiffener 90 and counterbalance 94 project or extend, and an inner peripheral surface 136 defining a hollow interior 138 of the dowel 82. The shaft 84 (FIG. 8) is received within the hollow interior 138.

It is noted that the asymmetry of the dowel 82 may extend at least along the axial segments 92 (FIG. 7), and that cross sections taken through other portions of the dowel 82 may be symmetrical with respect to the central rotational axis X. For example, a cross section taken at the circumferential gaps 102 will have the symmetrical shape of the core 100.

The bristle stiffeners 90 and counterbalances 94 may project an equal radial distance from the central rotational axis X of the dowel 82, or may project to slightly different radial distances, with the radial distance $r_S$ of the bristle stiffener 90 being defined by the stiffener tip 118 and the radial distance $r_C$ of the counterbalance being defined by the upper surface 128. In the embodiment illustrated herein, the bristle stiffener 90 projects farther than the counterbalance 94. Also in the embodiment illustrated herein, the bristle surface 114 projects slightly farther than the counterbalance 94.

As noted above, the dowel 82 can generally be configured with a geometry in accordance with the principles outlined for the brushroll 60 schematically illustrated and described for FIGS. 3-4, including, but not limited to, having a center of mass $C_1$ of the bristle stiffener 90 being diametrically opposite the center of mass $C_2$ of the counterbalance 94, with the sweep angle $2\alpha$ of the counterbalance 94 equally distributed relative to the center of mass $C_2$. Here also, the sweep angle $2\alpha$ of the counterbalance 94 is greater that the sweep angle $\beta$ of the bristle stiffener 90; thus, the counterbalance 94 extends a greater circumferential distance around the core 100 than the bristle stiffener 90.

The dowel 82, including the bristle stiffener 90 and counterbalance 94, can be integrally molded in one-piece. One suitable method for injection molding the dowel 82 of the brushroll 80 is disclosed in U.S. Patent Application Publication No. 2014/0259522, however, other dowel forming methods are also possible. The dowel 82 can comprise a polymeric material, such as polypropylene, ABS, or styrene. Additional finishing steps such as attaching the bristle tufts 96, 98, inserting the shaft 84 and assembling the bearing, 86 can also be performed to produce the finished brushroll 80. One suitable method for tufting the dowel 82 with the bristle tufts 96, 98, particularly the stiffened bristle tufts 96 adjacent the bristle stiffeners 90, is disclosed in U.S. Patent Application Publication No. 2014/0259522, however, other tufting methods are also possible.

The vacuum cleaner 10 and various brushrolls 60, 80 disclosed herein provide improved cleaning performance and increased flexibility in design. Currently, there is not much variation in brush tufting on brushrolls due to the need to keep the brushroll in rotational balance. As a consequence, most brushrolls are symmetrical about their rotational axis. The embodiments of the brushrolls described herein provide the opportunity for designs with an asymmetrical shape by incorporating an offsetting mass that will keep the brushroll in rotational balance.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A brushroll for a vacuum cleaner, comprising:

a dowel defining a central rotational axis and having at least one axial segment;

a bristle stiffener defining the axial length of the axial segment;

a plurality of first bristles protruding from the dowel adjacent to the bristle stiffener; and a counterbalance within at least a portion of the axial segment and positioned relative to the bristle stiffener to rotationally balance the at least one axial segment about the central rotational axis;

wherein the cross-sectional shape of the dowel is asymmetrical along the at least one axial segment.

2. The brushroll of claim 1, wherein the dowel is injection-molded and the bristle stiffener is integrally molded with the dowel.

3. The brushroll of claim 2, wherein the counterbalance is integrally molded with the dowel.

4. The brushroll of claim 1, wherein the counterbalance spans the axial length of the axial segment.

5. The brushroll of claim 1 and further comprising a plurality of second bristles protruding from the dowel non-adjacent to the bristle stiffener.

6. The brushroll of claim 5, wherein the first and second bristles are each in at least one tuft, and the diameter of the at least one tuft of first bristles is greater than the diameter of the least one tuft of second bristles.

7. The brushroll of claim 5, wherein the first and second bristles are each in at least one tuft, and the radial length of the at least one tuft of first bristles is less than the radial length of the least one tuft of second bristles.

8. The brushroll of claim 5, wherein the second bristles protrude from the counterbalance.

9. The brushroll of claim 1, wherein the counterbalance does not comprise any bristle stiffeners.

10. The brushroll of claim 1, wherein the radial projection of the bristle stiffener relative to the central rotational axis is greater than the radial projection of the counterbalance relative to the central rotational axis.

11. The brushroll of claim 1, wherein the dowel comprises multiple axial segments, with a bristle stiffener defining the axial length of each axial segment and a counterbalance within at least a portion of each axial segment that is positioned to rotationally balance each axial segment about the central rotational axis.

12. The brushroll of claim 11, wherein the cross-sectional shape of the dowel is asymmetrical along each axial segment.

13. The brushroll of claim 1, wherein the bristle stiffener extends helically around the dowel with respect to the rotational axis.

14. The brushroll of claim 13, wherein the counterbalance extends helically around the dowel with respect to the rotational axis.

15. The brushroll of claim 13, wherein the plurality of first bristles extend helically around the dowel with respect to the rotational axis.

16. The brushroll of claim 1, wherein the counterbalance is diametrically opposite the bristle stiffener.

17. The brushroll of claim 1, wherein the center of mass of the counterbalance is diametrically opposite the center of mass of the bristle stiffener.

18. The brushroll of claim 17, wherein the angle of sweep of the counterbalance is greater that the angle of sweep of the bristle stiffener.

19. The brushroll of claim 1, wherein the radial distance from the central rotational axis to the center of mass of the counterbalance is unequal to the radial distance from the central rotational axis to the center of mass of the bristle stiffener.

20. The brushroll of claim 1, wherein a diametric cross section of the dowel taken along the at least one axis segment comprises a symmetrical core with the bristle stiffener and the counterbalance protruding from the symmetrical core.

* * * * *